United States Patent [19]

Erickson et al.

[11] 4,045,145

[45] Aug. 30, 1977

[54] PITOT PUMP WITH TURBULENCE ELIMINATION

[75] Inventors: John W. Erickson, Huntington Beach; Vitolis Budrys, La Mirada, both of Calif.

[73] Assignee: Kobe, Inc., Huntington Park, Calif.

[21] Appl. No.: 642,326

[22] Filed: Dec. 19, 1975

[51] Int. Cl.[2] ..... F04D 1/14

[52] U.S. Cl. ..... 415/89

[58] Field of Search ..... 415/88, 89, 153, 157

[56] References Cited

U.S. PATENT DOCUMENTS

| | | | |
|---|---|---|---|
| 1,945,759 | 2/1934 | Sim | 415/89 |
| 2,584,424 | 2/1952 | Cornell | 415/89 |
| 3,307,485 | 3/1967 | Logue | 415/89 |
| 3,318,644 | 5/1967 | Johnson | 415/89 |
| 3,776,658 | 12/1973 | Erickson | 415/89 X |
| 3,795,459 | 3/1974 | Erickson et al. | 415/89 |
| 3,977,810 | 8/1976 | Erickson et al. | 415/89 |

FOREIGN PATENT DOCUMENTS

| | | | |
|---|---|---|---|
| 886,143 | 6/1943 | France | 415/89 |
| 1,014,234 | 5/1952 | France | 415/89 |
| 25,980 | 11/1923 | France | 415/89 |
| 492,854 | 9/1938 | United Kingdom | 415/89 |

*Primary Examiner*—Carlton R. Croyle
*Assistant Examiner*—Donald S. Holland
*Attorney, Agent, or Firm*—Christie, Parker & Hale

[57] ABSTRACT

A pitot pump having a stationary vane containing a pitot tube mounted inside a rotating housing. Fluid is delivered to the interior of the housing through a plurality of radial ducts in the walls of the casing which discharge fluid by centrifugal force into the housing. Means is provided in the casing for distributing fluid discharged from the ducts in a manner to reduce impact of the fluid against the stationary vane.

3 Claims, 7 Drawing Figures

10
11
19
15
2
12
14
49
25
35
37
42
16
39
28
51
33
23
50
56
47
17
22
31
32
54
46
13
53
9
54
18
55
30
48
56
34
54
24
52
51
20
26
25
21
37
49
36
27
38
2

PITOT PUMP WITH TURBULENCE ELIMINATION

FIELD OF THE INVENTION

This invention relates to centrifugal pumps, and more particularly is concerned with pitot pumps and pitot pump type centrifugal separators.

BACKGROUND OF THE INVENTION

Pitot pumps are a form of centrifugal pump. Typically, a pitot pump is constructed by providing a hollow rotatable casing disposed within a surrounding housing. A plurality of radial tubes in the walls of the casing force the fluid to be pumped outwardly through the ducts by centrifugal force as the casing is rotated, the fluid being discharged into the casing. A stationary pitot tube in the interior of the casing intercepts the rotating fluid in the casing, the ram effect forcing fluid out through the pitot tube. Pitot pumps of this type are well known, as shown in U.S. Pat. Nos. 3,795,459, 3,817,659, and 3,838,939, all of which are owned by the assignee of the present invention.

It has furthermore been proposed heretofore to use pitot pumps to pump oil produced from a well, which oil may contain contaminants such as notably sand, which it is desirable to remove from the oil being pumped. Pitot pumps can be used to provide both pumping action for the oil and as a centrifugal separator by which sand or other contaminants are removed from the oil as the oil is pressurized. Whether utilized as a pump or a pump-separator, the pump includes a stationary vane projecting inside the casing which is used to support the pitot tube and which also operates to agitate the centrifically separated accumulations of contaminant matter on the casing inner surface at the outer periphery of the chamber in the casing. This vane should be made as thin as possible in a direction parallel to the axis of rotation of the casing in order to minimize interference with the rotating mass of fluid within the interior of the casing. However, in the past the fluid pumped into the housing of the casing through the radial ducts through centrifugal force had a large component velocity of flow in a direction parallel to the axis of rotation, thus imposing a substantial lateral force on the stationary vane (a force in the direction parallel to the axis of rotation), imposing a severe strain on the relatively thin vane. This lateral force is not constant but pulsates as each discharge duct rotates past the region of the vane. This pulsating force has in some cases resulted in structural failure of the stationary vane.

SUMMARY OF THE INVENTION

The present invention is directed to an improved construction in a pitot pump of the type having a rotary casing forming a pumping chamber with a stationary element extending radially within the chamber, the stationary element defining a pitot tube. The pitot tube adjacent its outer end forms an inlet to the tube facing in a direction opposite to the direction of rotation of the casing, the pitot tube having a passage connected to the inlet and extending generally in the direction of casing rotation and toward the axis where it connects with a discharge duct coaxial with the casing. A plurality of supply passages deliver fluid from a supply duct to the periphery of the pumping chamber, the supply passages extending radially outwardly and terminating in discrete discharge openings spaced circumferentially around one end wall of the pumping chamber. According to the improvement of the present invention, means is provided at the outer end of each of the supply passages for diffusing flow of fluid from the discharge opening into the pumping chamber to reduce the axially directed component of velocity of the fluid impinging on the stationary element from the supply passages.

The present invention has particular importance in a pump-separator in which contaminants, including solids such as sand and mud fines, are separated by centrifugal action through discharge nozzles around the outer periphery of the pumping chamber. By diffusing the flow of fluid into the chamber turbulence is reduced in the intermediate region between the pitot tube and the outer perimeter of the chamber. This permits the fines to migrate outwardly and collect in greater concentration at the outer perimeter of the chamber, where, under the action of the vane, they are agitated sufficiently to be carried out through the discharge nozzles. It has been found that by reducing the velocity of the fluid entering from the side of the chamber, the efficiency of the separator in removing contaminates is greatly improved.

DESCRIPTION OF THE DRAWINGS

For a better understanding of the invention, reference should be made to the accompanying drawings, wherein.

DETAILED DESCRIPTION

Figure 1:
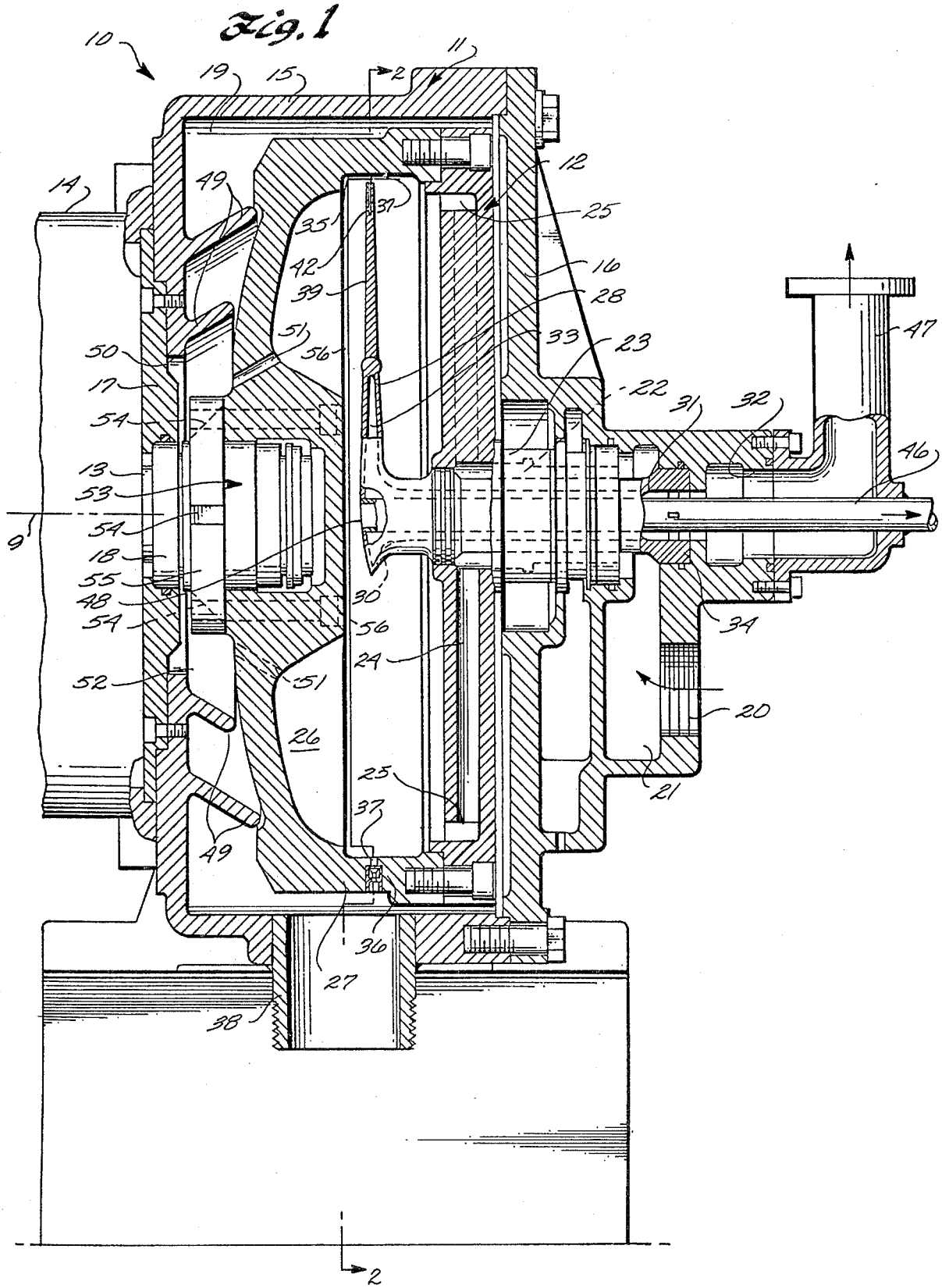
FIG. 1 is a cross-sectional view taken along the line 1—1 of FIG. 2.
Figure 2:
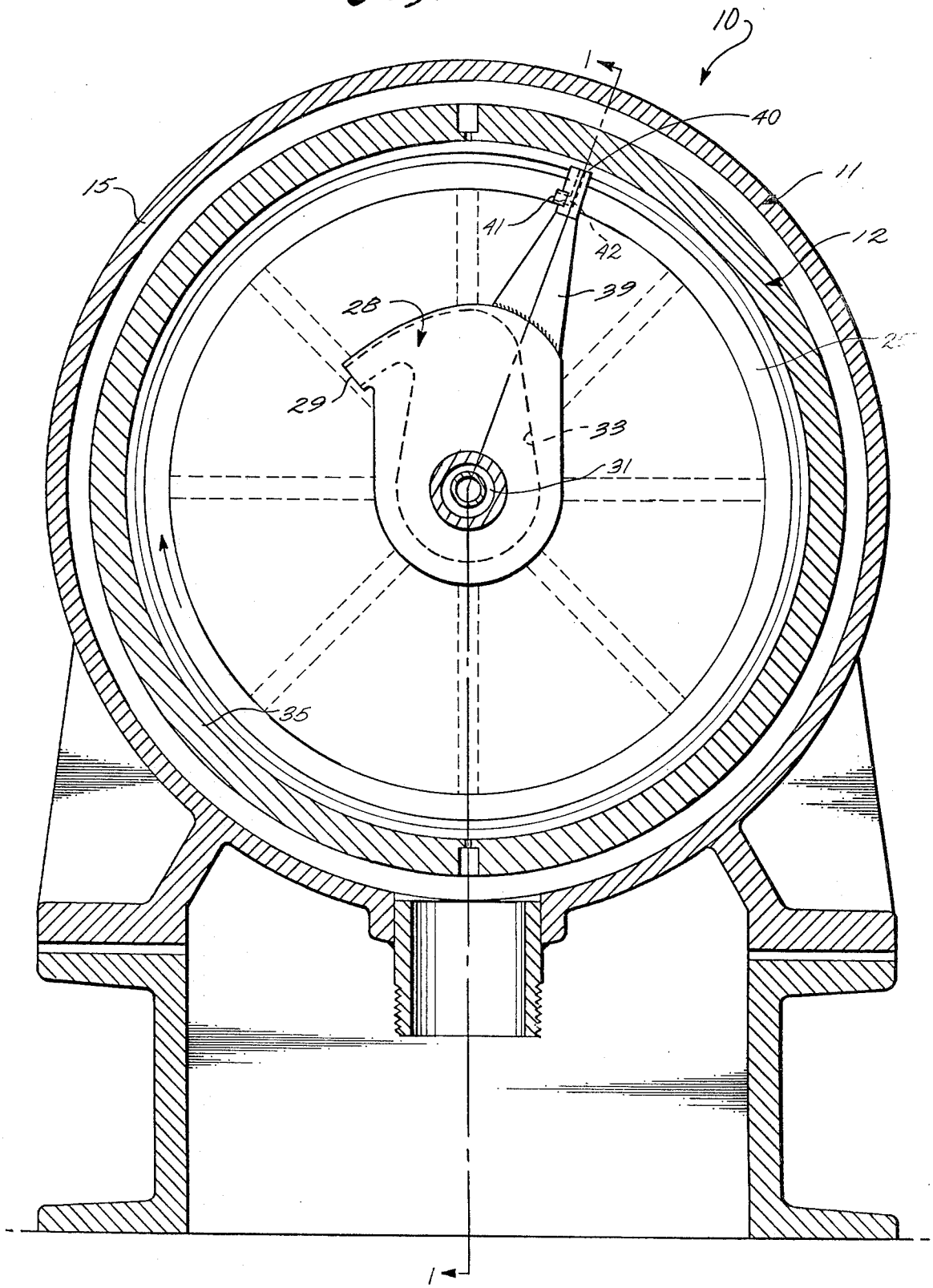
FIG. 2 is a sectional view taken substantially on the line 2—2 of FIG. 1.

A pitot pump-separator 10, shown in FIGS. 1 and 2 includes an outer housing 11 and a hollow rotary casing 12. The casing is mounted coaxially to the shaft 13 of an electric motor (not shown), which is connected to the housing via a motor support and bearing assembly 14, for rotation about axis 9 which is also the axis of symmetry of the casing. The housing is composed principally of an annular casting 15 open at one end opposite from the drive motor where it is closed by a cover 16. A smaller cover 17 closes the other end of the casting and mounts a suitable seal 18 which cooperates with the shaft to prevent leakage of fluid from a housing chamber 19 along the drive shaft into the motor and bearing support assembly. Shaft 13 is supported within assembly 14 by suitable bearings (not shown) so that it may carry the rotary casing in a cantilever fashion within the housng chamber.

Housing cover 16 defines an inlet 20 for fluid to be pumped. The inlet opens to a chamber 21 which leads to an annular inlet passage 22 formed coaxially through an axial inlet hub 23 of the rotary casing. A plurality of generally radial ducts 24 are formed within the end wall of the casing adjacent housing cover 16 and open through an annular groove 25 to a generally circular central pumping chamber 26 within the casing. Groove 25 is located relatively closely adjacent to the outer periphery 27 of the casing. Ducts 24 provide fluid flow communication between annular inlet passage 22 and the casing chamber. Fluid is pumped by centrifugal force outwardly through the ducts 24 as the casing rotates, impinging against the outer wall of the groove 25 and passing into the chamber 26. The groove 25 distributes the fluid uniformally around the periphery of the chamber, thereby diffusing the flow of fluid into the chamber and substantially reducing the axial component of fluid velocity.

Within the pumping chamber is a stationary pitot or pickup tube 28 which is oriented radially of axis 9 and is provided adjacent its outer end with an inlet 29 (FIG. 2) facing in a direction opposite to the direction of rotation of the rotary casing. The pitot tube has an outlet 30 coaxial with axis 9, the outlet communicating with an axial discharge duct 31 leading to an outlet port 32 from the housing. The inlet passage surrounds the discharge duct throughout a portion of the length of the latter which is defined by a bore through an axial hub 34 of the pitot tube. Within the pitot tube, in a manner well known, is a passage 33 which is connected to the pitot inlet and which extends generally in the direction of casing rotation and toward the axis of the pump where it communicates with the pitot outlet 30. The pitot tube hub is supported in housing cover 16 in a stationary manner for rotation of the casing about the pitot tube hub. Thus, fluid to be pumped and pumped fluid enter and leave the pump in a counterflow manner coaxially of the casing at the end of the pump opposite the drive motor.

The general mode of operation of this apparatus as a pitot pump is well known so that it does not need to be described in great detail. Briefly, as casing 12 is rotated at high speed in a predetermined direction (see the arrow in FIG. 1) about its axis, casing ducts 24 collectively function as a centrifugal pump to draw fluid to be pumped and cleaned into inlet 20 and to discharge such fluid into the pumping chamber adjacent the outer periphery of the casing through the annular groove 25. Fluid in the pumping chamber rotates with the casing and enters the inlet of the pitot tube, the pressure of the fluid entering the pitot inlet being increased by a ram effect which converts the velocity head of such fluid into pressure due to the configuration of the pitot passage 33. The pumped fluid entering the pitot tube flows through the pitot passage, into the discharge duct, and to the main outlet port 32 from the housing. Heavy solid or viscous constituents (contaminants) in fluid introduced into the pumping chamber are acted upon within the pumping chamber by centrifugal force, and tend to accumulate and concentrate along the inner wall of the casing at its outer periphery.

The pitot tube is arranged so that its inlet is disposed intermediate the casing axis and the outer periphery of the rotary casing, rather than closely adjacent the outer periphery of the casing, so as to collect pumped fluid from which a major portion of the contaminant has been removed. The precise location of the pitot tube inlet radially of the casing is selected with regard to the pressure to be produced by the pump and the amount and extent of contaminant which is tolerable in the pump discharge.

A plurality of contaminant discharge jet orifice nozzle assemblies 36 are mounted in the outer periphery of the rotary casing adjacent the outer ends of suitable contaminant discharge passages 37 (see FIGS. 1 and 2). Preferably the inlet ends of passages 37 are all aligned in a common plane perpendicular to the pump axis; the pitot tube inlet preferably is centered in this plane in pump-separator 10. Jet nozzles 36 and passages 37 provide communication from the interior of the casing to the interior of the housing. During operation of the pump-separator, contaminants accumulated along casing inner wall 35 are continuously discharged through passages 37 and the nozzles into housing chamber 19. Contaminants passed into the housing flow through a contaminant discharge port 38 formed in the lowermost extent of the housing.

A stirrer vane 39 is mounted to the outer end of the pitot tube (as shown best in FIG. 1) and extends radially of the pump axis to an outer end 40 which is spaced closely adjacent to the casing inner surface. The close cooperation between the vane end and the inner surface of the rotary casing generates turbulence in the outermost extent of the pumping chamber, which turbulence agitates and dislodges accumulations of contaminant matter tending to be centrifugally deposited upon the casing inner walls. This agitation and dislodging of contaminants promotes flow of the contaminants through the jet nozzles and counteracts any tendency of the contaminants to merely accumulate on the casing inner surface. In other words, the cooperation of the vane with the casing inner surfaces minimizes the thickness, radially of the casing, of any stagnant or low velocity laminar flow boundary layer which may tend to form in the pumping chamber along its outer periphery and from which heavy constituents of the inlet fluid tend to separate and build up on the casing surfaces. This result, in addition to enhancing the contaminant separation and discharge operation, also maintains the dynamic balance of the rapidly rotating rotary casing. Maintenance of the dynamic balance of the rotary casing prevents vibration and prolongs the useful life of the unit, especially the seals and bearings associated with the rotating elements of the unit and its drive motor.

Preferably the clearance between the outer end of the stirrer vane and the inner surface of the casing is on the order of 0.125 inch or so. It is also preferred that the extreme tip end of the stirrer vane be defined of a very hard wear-resistant material, such as tungsten carbide, so that the stirrer vane is not unduly eroded by the contaminant materials, particularly solid contaminant materials, concentrated at the casing inner surface during operation of the pump-separator.

It has been found that when the fluid handled by the pump-separator is a mixture of oil and sand, in which the oil is to be pumped and the sand is to be separated, a simple stirrer vane, even one with a tungsten carbide tip, rapidly erodes at its tip. However, the vane does function to keep the inner surface of the casing clean until the stirrer vane tip has eroded substantially. To prevent such vane erosion, the tip end portion of the stirrer vane includes a pitot-type jet nozzle that has an inlet 41 which faces from the stirrer vane in a direction opposite to the direction of rotation of the rotary casing. The jet inlet communicates to a passage 42. Inlet 41 is spaced sufficiently inwardly from the casing surface that it receives relatively clean fluid from the pumping chamber, which fluid is discharged at high velocity and pressure from the passage to the casing surface to agitate and dislodge centrifugally deposited accumulations of contaminant matter, especially solid contaminant matter, on the casing inner surface. It has been found that incorporation of jet passage 42 in the outer end portion of stirrer vane 39 substantially entirely eliminates erosion of the stirrer vane and clogging of nozzles 36 during handling of sand-contaminated oil and the like.

To better adapt pump-separator 10 for use as a pressurizer for the motive fluid, oil, supplied to a well bore pump, a gas extraction tube 46 is disposed coaxially within the hub of the pitot tube assembly. The gas extraction tube is located within discharge duct 31 so as to extend through discharge port 32, and preferably also through a collection fitting 47 connected to the housing for receiving pumped fluid from the discharge port. The discharge duct 31 from the pitot passage is annular and is defined about the exterior of the gas extraction tube which has an inlet 48 into the pumping chamber through the pitot tube assembly along the pump axis.

It is quite common for gas to be present, either in its free state or in solution, in oil extracted from an oil well, and the presence of such gas in oil introduced to the pump-separator 10 tends to accumulate in the central portion of the pumping chamber. Such accumulated gas enters the gas extraction tube for removal from the pump chamber separately from the removal of pumped fluid from the pumping chamber via the pitot tube assembly. The presence of gas extraction tube 46 in pump-separator 10 assures that free gas in the pumping chamber does not accumulate in sufficient quantities to enter the pitot passage with oil from which sand and the like has been separated. It will be understood, however, that if the oil extracted from the oil well of interest contains large quantities of free gas, say, greater than 5% by volume, it may be preferable to extract such gas from the oil in a conventional gas/oil separator before introducing the oil into the pump-separator.

To assure trouble-free operation of pump-separator 10, it is desirable that the fluid presented to the casing side of the seal assembly 18 be as free of sand or other solid contaminants as possible, and that a flow of relatively clean fluid be established across the casing side of the seal assembly to wash away any solid contaminants which may enter the vicinity. Solid contaminants introduced into chamber 19 through jet nozzle assemblies 36 are routed away from the area of the seal assembly, as they move to contaminant discharge port 38, by a plurality of deflector baffles 49 connected to the inner walls of the housing adjacent to the seal assembly. As shown in FIG. 1, the deflector baffles preferably are formed integral with the inner walls of the housing concentric to the axis 9 circumferentially around the housing opening 50 which is closed by cover 17. Each baffle increases in diameter proceeding into the housing chamber along axis 9. Accordingly, each of the baffles has a configuration of a truncated right cone. The ends of the baffles spaced from the housing wall cooperate closely with the adjacent surfaces of the rotary casing 12. Sand present in the upper portions of the housing chamber 19 falls upon the convex outer surfaces of the baffles and slides along the inclined surfaces of the baffles toward the housing wall and downwardly along the housing wall to the lower portions of the housing chamber, rather than tending to pass through the spaces between the ends of the baffles and the casing into the vicinity of the seal assembly 18.

During operation of the pump-separator 10, the casing side of the seal assembly is bathed by relatively clean pumped fluid applied to the vicinity of the seal assembly by a plurality of circulation passages 51 in the rotary casing. The passages open at their ends opposite from the pumping chamber into the space 52 adjacent the seal assembly which is encircled by the innermost one of the deflector baffles 49. A coupling 53 is screwed to the end of motor shaft 13 within the housing chamber for mounting the rotary casing to the shaft. A notch 54 is cut in a flange 55 of the coupling in alignment with each of the circulation passages so that pumped fluid emerging from the passages into space 52 may be sprayed directly upon the casing side of the seal assembly. Flange 55 is provided on the coupling to receive bolts 56 which connect the casing to the coupling. Thus, any particles of sand or other contaminant materials which may enter into the immediate vicinity of the inner side of the seal assembly 18 are washed away from the seal assembly by virtue of the continuous spray of a small portion of relatively clean fluid taken from the pumping chamber for this purpose.

In the past it has been the practice to have the ducts 24 open directly into the chamber 26 through relatively small openings in the inner sidewall of the chamber 26. In such an arrangement the fluid pumped centrifugally outwardly through the ducts 24 was discharged in the form of high velocity jets into the chamber 26 spaced circumferentially around the perimeter of the chamber 26. The positions of these jets of course rotates relative to the stirrer vane 39. Thus the stirrer vane 39 has been subjected to a pulsating lateral force which weakens the stirrer vane through metal fatigue, frequently resulting in structural failure. By the present invention, the fluid pumped radially outwardly through the ducts 24 discharges radially into an annular groove 25. The velocity of the fluid is largely dissipated by impact with the outer wall of the groove and distribution of the fluid around the groove as it flows into the main portion of the chamber 26. As a result, lateral impact on the stirrer vane 39 is reduced and smoothed out, thus eliminating the tendency for failure through metal fatigue.

The modified flow path provided by the present invention between the radial ducts 24 and chamber 26 also results in much better separation of fines from the liquid. The fines tend to become more concentrated at the outer perimeter of the chamber where they are removed through the discharge passages 37 due to reduction in turbulence inwardly from the outer periphery of the chamber.

Figure 3:
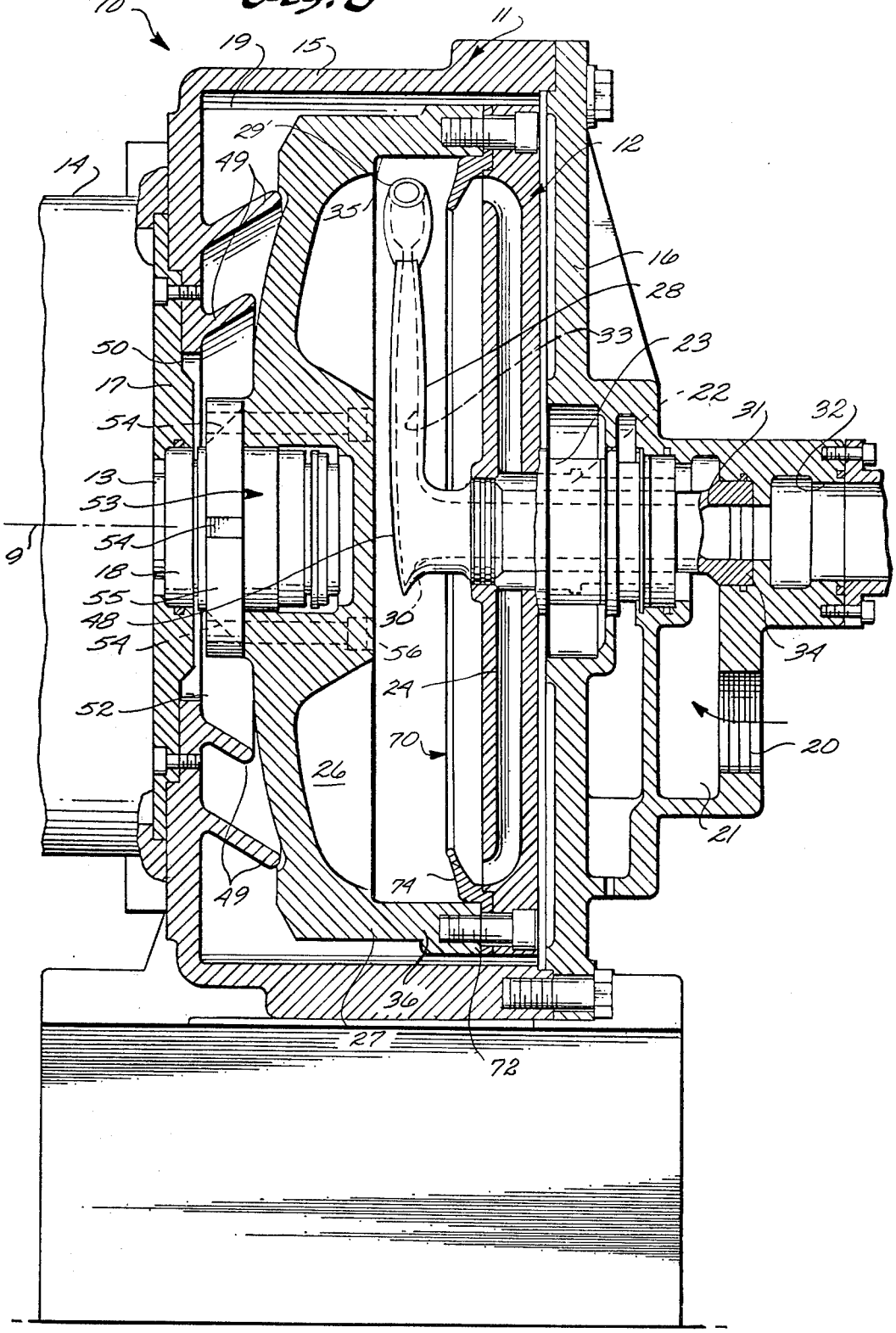
FIG. 3 is a cross-sectional view similar to FIG. 1, but showing an alternate embodiment of the invention.
Figure 4:
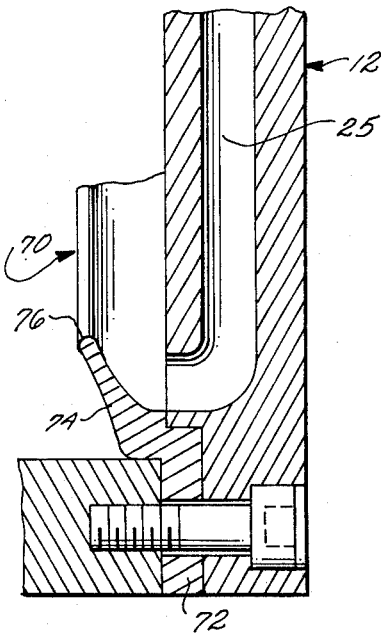
FIG. 4 is an enlarged fragmentary sectional view of the embodiment of FIG. 3.

Referring to the modification of FIG. 3, there is shown a pitot pump. The pump is similar to the pump-separator of FIGS. 1 and 2 and similar parts are identically numbered in the figure. However, in pumping fluids where the separator function is not required, the pitot tube 28 extends radially outwardly to the periphery of the chamber 26 where it terminates in an inlet tube 29'. Since the pitot tube converts fluid velocity to a pressure head, the pump of FIG. 3 by positioning the inlet tube at a larger radius produces a higher outlet pressure.

In the arrangement of FIG. 3, the outer end of the pitot tube is isolated from lateral forces due to an axial component of fluid velocity from the discharge of the radial ducts 24 by a shroud element 70 which has an outer flange portion 72 that is bolted between the opposing faces of the two sections forming the casing 12. The shroud 70 has an inwardly projecting fluid deflector lip 74 terminating at a circular edge 76 extending around the interior of the chamber 26. Fluid discharged axially from the outer ends of the ducts 24 impinges on the lip 74 of the shroud 70, thereby directing the fluid into the chamber 26 in a direction back toward the axis of rotation of the casing. Thus the shroud prevents the fluid from directly impinging on the pitot tube in a direction parallel to the axis of rotation of the casing, but rather directs the fluid in toward the inner end of the pitot tube where the pitot tube is better able to withstand any axially directed force.

Figure 5:
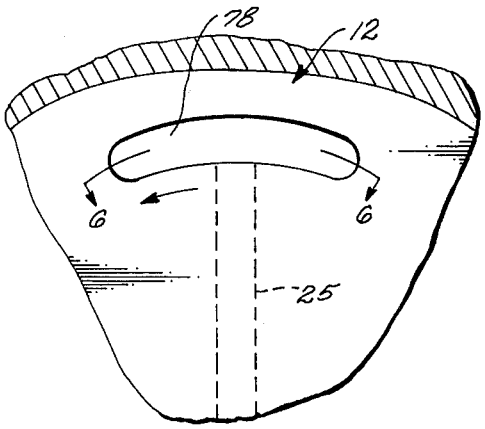
FIG. 5 is a fragmentary view of an alternative embodiment of the invention.
Figure 6:
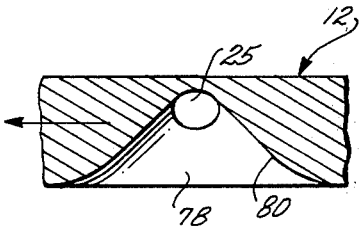
FIG. 6 is a fragmentary sectional view taken substantially on the lines 6—6 of FIG. 5.
Figure 7:
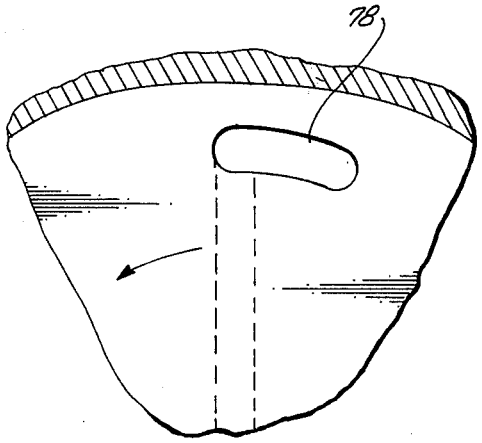
FIG. 7 is a fragmentary view of a further embodiment of the invention.

A further embodiment is shown in FIGS. 5 and 6 in which each of the radial ducts 24 in the sidewall of the casing 12 opens into a slot 78 formed in the inner sidewall of the chamber 26. The slot extends arcuately on either side of the duct 24 with the inner surface 80 of the slot 78 being tangent with the wall of the duct 24 and tapering outwardly on either side of the duct, as best shown in FIG. 6. Alternatively, as shown in FIG. 7, the slot may be tapered only in a direction opposite to the direction of rotation of the casing. In either event, the effect of the slot 78 is to substantially reduce the component of velocity of the fluid as it enters the chamber 26 from the duct 24 in a direction parallel to the axis of rotation of the casing. Thus the effect of the slot 78 is to reduce the lateral force of fluid against the pitot tube during operation of the pump.

What is claim is:

1. A pitot pump including:

a. a rotary casing mounted for rotation in a selected direction about an axis and having a pumping chamber therein;

b. a pumped fluid discharge duct coaxial with the casing;

c. a stationary element extending radially of said axis in the casing to an outer end thereof disposed toward the inner surface of the casing at the outer periphery of the pumping chamber, the element defining a pitot tube extending radially of the axis and having adjacent its outer end an inlet facing in a direction opposite to the direction of rotation of the casing for gathering from the chamber fluid to be pumped, the pitot tube having a passage connected to the inlet and extending generally in the direction of the casing rotation and toward the axis to an outlet connected to the discharge duct for discharging to the outlet duct fluid gathered from the chamber by the pitot tube inlet; and d. delivery means for delivering fluid to be pumped to the pumping chamber proximately of the outer periphery thereof, the delivery means including:

1. a supply duct coaxially of the casing, 2. a plurality of supply passages in an end wall of the casing for delivering fluid from the supply duct to the periphery of the pumping chamber, the supply passages having discrete continuously open discharge openings spaced circumferentially around the one end wall of the pumping chamber near the periphery thereof, and 3. means carried by the one end wall adjacent the discharge end of each of the supply passages for diffusing flow of fluid from each discharge opening into the pumping chamber for reducing in the chamber in the vicinity of the stationary element the velocity, in a direction substantially parallel to the axis, of fluid delivered to the pumping chamber by the supply passages, wherein the diffusing means includes a shroud member extending radially inwardly into the chamber between the stationary element and the outlet ends of the supply passages for diverting the flow of fluid out of the passages into the chamber in a direction toward the axis of rotation of the casing.

2. A pitot pump including:

a. a rotary casing mounted for rotation in a selected direction about an axis, the casing being a chamber therein;

b. a pumped fluid discharge duct coaxial with the casing;

c. a stationary element extending radially of said axis in the casing to an outer end thereof disposed toward the inner surface of the chamber at the outer periphery thereof, the element defining a pitot tube extending radially of the axis and having adjacent its outer end an inlet facing in a direction opposite to the direction of rotation of the casing, for gathering from the chamber fluid to be pumped, the pitot tube having a passage connected to the inlet and extending generally in the direction of casing rotation and toward the axis to an outlet connected to the discharge duct for discharging to the outlet duct fluid gathered from the chamber by the pitot tube inlet;

d. delivery means for delivering fluid to be pumped to the interior of the casing proximately of the outer periphery thereof, the delivery means including:

1. an inlet supply duct extending coaxially of the casing, 2. means providing in an end wall of the casing separately from and out of communication with the pitot tube passage along their extent a plurality of supply passages extending radially of the axis from the supply duct to terminal portions continuously opening into the chamber at a radial distance from the axis that is less than the radial extent of the stationary element, and 3. flow diffusing means carried by the one end wall of the casing in association with the outlet ends of the supply passage terminal portions for distributing fluid discharged into the interior of the casing from the passages over a wide path, wherein the diffusing means includes a shroud member extending radially inwardly into the chamber between the stationary element and the outlet ends of the supply passages for diverting the flow of fluid out of the passages into the chamber in a direction toward the axis of rotation of the casing, whereby in operation of the pump the stationary element experiences reduced impact by fluid to be pumped supplied in response to rotation of the casing in the selected direction.

3. In a pitot pump having a rotary casing with a stationary pitot tube extending radially from the axis of rotation toward the outer periphery of a chamber centered on the axis of rotation, the pitot tube having an inlet at the outer end aligned with the direction of rotation for receiving from the chamber fluid to be pumped, the pitot tube having support at the inner end along the axis of rotation of the casing and having a fluid discharge duct passing through the casing along the axis, fluid to be pumped being admitted to the chamber through a plurality of radial ducts defined in an end wall of the casing separate from and out of communication with the pitot tube along their extent, the ducts discharging fluid at discrete continuously open discharge openings spaced circumferentially around one end wall of the chamber near the outer periphery, the improvement comprising:

means associated with the discharge openings of the supply passages and carried by the casing for reducing the flow velocity of fluid into the chamber in a direction parallel to the axis of rotation, wherein said means includes shroud means projecting into the chamber from the outer periphery toward the axis, the shroud means extending radially inwardly past the discharge openings of the supply passages into the chamber so as to divert the flow of fluid entering the chamber from the passages toward the axis of rotation while shielding the outer end of the pitot tube, whereby the impact of the fluid entering the chamber with the stationary pitot tube structure is minimized.

* * * * *